US007011428B1

(12) United States Patent
Hand

(10) Patent No.: US 7,011,428 B1
(45) Date of Patent: Mar. 14, 2006

(54) LUMINAIRES HAVING PATTERNED SURFACES

(75) Inventor: Mitchell Cecil Hand, McDonough, GA (US)

(73) Assignee: Acuity Brands, Inc., Atlanta, GA (US)

( * ) Notice: Subject to any disclaimer, the term of this patent is extended or adjusted under 35 U.S.C. 154(b) by 104 days.

(21) Appl. No.: 10/625,297

(22) Filed: Jul. 22, 2003

(51) Int. Cl.
*F21S 4/00* (2006.01)

(52) U.S. Cl. ..... 362/217; 362/351; 362/806

(58) Field of Classification Search ..... 362/351, 362/217, 252, 260, 257, 225, 226, 362, 354, 362/360, 361, 346, 806; 52/630, 384, 578; D26/72–79
See application file for complete search history.

(56) References Cited

U.S. PATENT DOCUMENTS 2,131,442 A * 9/1938 Korengold ..... 362/327
3,487,206 A * 12/1969 Dawson et al. ..... 362/487
3,675,008 A * 7/1972 Hill ..... 362/355
4,006,355 A * 2/1977 Shemitz et al. ..... 362/217
4,855,877 A * 8/1989 Otaka ..... 362/509
5,570,947 A * 11/1996 Felland ..... 362/148
6,070,908 A * 6/2000 Skrzypchak ..... 280/847
6,193,394 B1 * 2/2001 Herst et al. ..... 362/260
D471,377 S * 3/2003 Gledhill et al. ..... D6/432
6,558,022 B1 * 5/2003 Kawahara ..... 362/257
6,575,613 B1 * 6/2003 Brown et al. ..... 362/565

* cited by examiner

*Primary Examiner*—Thomas M. Sember
(74) *Attorney, Agent, or Firm*—Kenneth E. Darnell

(57) ABSTRACT

A luminaire having a housing and/or a reflector formed of a patterned material or a material having a pattern disposed on at least a portion or portions thereof reminiscent of a person, place or thing associated with an experience pleasing to an observer of said luminaire, the invention finds particular utility in the formation of a luminaire such as a shoplight as can be employed in a work space such as a space wherein automotive activities are conducted, a luminaire configured according to one embodiment of the invention being formed of a separate channel and reflector and in another embodiment of the invention with at least portions of a reflector formed integrally with a channel. In particular embodiments of the invention, a pattern referred to in the art as a diamond tread plate pattern is employed in order to produce an association of the luminaire with motor sport activities such as professional auto racing and particularly stock car racing.

14 Claims, 9 Drawing Sheets

LUMINAIRES HAVING PATTERNED SURFACES

BACKGROUND OF THE INVENTION

1. Field of the Invention

The invention relates to luminaries and to methods for producing an association of a luminaire with a person, place or thing such as an activity by forming at least a portion of such luminaries with a pattern reminiscent of such person, place or thing.

2. Description of the Prior Art

A material usually referred to in the art as diamond tread plate is commonly employed in the manufacture of truck bed tool boxes, slip-resistant treads, truck beds and the like, the material typically being formed of a metal such as aluminum. The known material is available from manufacturers such as Hadco Aluminum of Jamacia, N.Y. 11433 as sheet material of varying thicknesses such as a thickness of 0.036 inch in a bright anodized aluminum finish. Patterns available on such sheet material include four-sided geometrical figures such as are known as diamonds, such diamonds typically having sides of equal length with two opposite included angles being acute angles and with the other two opposite included angles being obtuse angles. The diamonds each have a longitudinal axis extending between the acute angles and constituting a length-wise dimension and a lateral axis extending between the obtuse angles and constituting a width-wise dimension, the length-wise dimension being preferably greater than the width-wise dimension. In preferred embodiments, the length-wise dimension is at least twice the width-wise dimension and greater including three to four times relative dimensions. In a preferred pattern, rows of said diamonds are seen to have each diamond disposed parallel to each other within a given row with alternating rows having diamonds angled in the same sense, such as at 45° to a line joining adjacent end points of said diamonds, other rows of parallel diamonds being disposed in an interdigitated arrangement with said first-mentioned rows, the diamonds in the other rows being angled at 90° to the diamonds in the first-mentioned rows. One preferred pattern of a suitable aluminum diamond tread plate designated as 5086-H34 tread plate is the C-102 pattern, this material being available in thickness ranges suitable to a practice of the invention.

Diamond tread plate patterned material is disclosed in U.S. Pat. Nos. 5,244,335 and 5,676,087 for use as a material from which surfaces intended to be walked upon can be formed, the diamond pattern providing a non-slip surface. United States design patent D349,091 discloses a toolbox mountable to a truck bed and walls of the bed, the toolbox having walls formed of a diamond tread plate material. The truck bed toolbox of this and other design patents typically have surfaces that can be walked upon with a reduced chance of slippage due to the provision of the diamond pattern so disclosed. Diamond tread plate patterns are therefore known and are primarily intended for use in the formation of slip-resistant surfaces on articles of manufacture such as tread plates, toolboxes and the like.

The invention utilizes diamond tread plate patterns and materials having such patterns formed thereon in the manufacture of luminaries and particularly shoplights such as are suspended from ceilings of work spaces to illuminate such spaces, the diamond pattern material forming at least portions of a luminaire channel and/or reflector, certain embodiments of the invention being configured with at least portions of the reflector comprising at least a portion of the channel and functioning as such as a housing for the mounting of lamp holders, lamping and the like thereon or thereto. Formation of at least portions of a luminaire from a diamond tread plate material and/or pattern evokes an association with an activity or a person, place or thing, such association providing a feeling on the part of an observer definable as pleasing to such observer so that the observer develops a desire to utilize a luminaire so configured in a space to be illuminated and particularly in a space within which an activity occurs that can have an association with a particular person, place or thing. In particular, a luminaire so configured is evocative of motor sports activities such as stock car racing due to association of a luminaire so patterned and so formed with automotive activities and/or activities undertaken by individuals who favor motor sports as pleasurable leisure time and/or professional pursuits.

SUMMARY OF THE INVENTION

The invention provides in several embodiments both methods and articles having utility derived from the configuration of luminaires with a material or materials formed with a particular pattern or patterns evocative of association with a person, place or thing and particularly an activity such as motor sports including stock car racing. Physical embodiments of the invention are conformed with at least one portion of a luminaire such as a housing and/or a reflector or portions thereof with a material having a diamond pattern formed thereon, a particularly useful pattern being known as diamond tread plate by virtue of previous use on metallic plate-like treads wherein the diamond pattern is intended to provide a slip-resistant surface on such tread plates.

Suitable diamond patterns take the form of raised diamonds having length-wise dimensions of at least twice width-wise dimensions with such diamonds being parallel within given rows and angled such as at an angle of 45° to a reference line taken through aligned end points of the diamonds of each row, rows of oppositely angled diamonds being interdigitated between the first-mentioned rows. Diamonds within each row are spaced apart a distance slightly greater than the length-wise dimension of each diamond. The effect of the diamond pattern is that of diagonally disposed aligned diamonds with alternate diamonds having longitudinal axes thereof aligned and with interdigitated diamonds having lateral axes aligned with the longitudinal axes of the diagonally aligned diamonds. The material is typically formed with a bright, reflective finish.

Luminaires so configured preferably have housing portions or channels either discernable from reflector portions or fully or at least partially integrally formed therewith such that a structural portion of the luminaire essentially defines reflector portions of such luminaries, lamping and lamp holders and the like being mounted either by a channel or by combined channel and reflector structure. The diamond tread plate pattern can be formed over exterior surfaces of such channels and/or reflectors or over at least portions of combined support and reflector structures. Particular luminaires intended to exhibit utility according to the invention are shoplights including strip fluorescent luminaires as are typically used in work spaces wherein such luminaires are suspended such as by wire supports from ceilings of such work spaces.

Configurations of the invention permit practice of the methodology wherein such methods are practiced with the intent of evoking associations with activities or with persons, places or other things as are of interest from the view point of an observer, the configuration of a shoplight according to the invention with a diamond tread plate pattern as one example and used within a work space generating associations with automotive activities such are typically enjoyed by individuals familiar with such diamond tread plate patterns in association with tread plates or bed-mounted tool boxes often carried by trucks such as pick-up trucks and which are commonly used by segments of the general population having an affinity for automotive activities such as motor sports and particularly stock car racing. The disposition of a luminaire configured according to the invention within a work space or other environmental space thus imparts to an observer a pleasing association with an activity or person, place or thing of importance to the observer.

Accordingly, it is an object of the invention to provide a luminaire having a pattern disposed over at least surface portions thereof, the pattern evoking a response on the part of a user of the luminaire that is associated with an activity or person, place or other thing of importance to the user.

It is another object of the invention to provide a diamond tread plate pattern on surfaces of a channel and/or reflector of a luminaire to produce a decorative affect having an emotional association with an activity of significance to a user of the luminaire.

It is a further object of the invention to provide methods relating to the configuration of luminaires with patterns formed on surfaces thereof intended to produce interest on the part of a user of said luminaires through association of the patterns on the luminaires with an activity or a person, place or other thing that is of importance to the user.

Further objects and advantages of the invention will become more readily apparent in light of the following detailed description of the preferred embodiments.

DESCRIPTION OF THE PREFERRED EMBODIMENTS

The disclosure of United States design patent application entitled "Patterned Luminaire", by the same inventor and assigned to the same assignee and filed of even date, is incorporated hereinto by reference.

Figure 1:
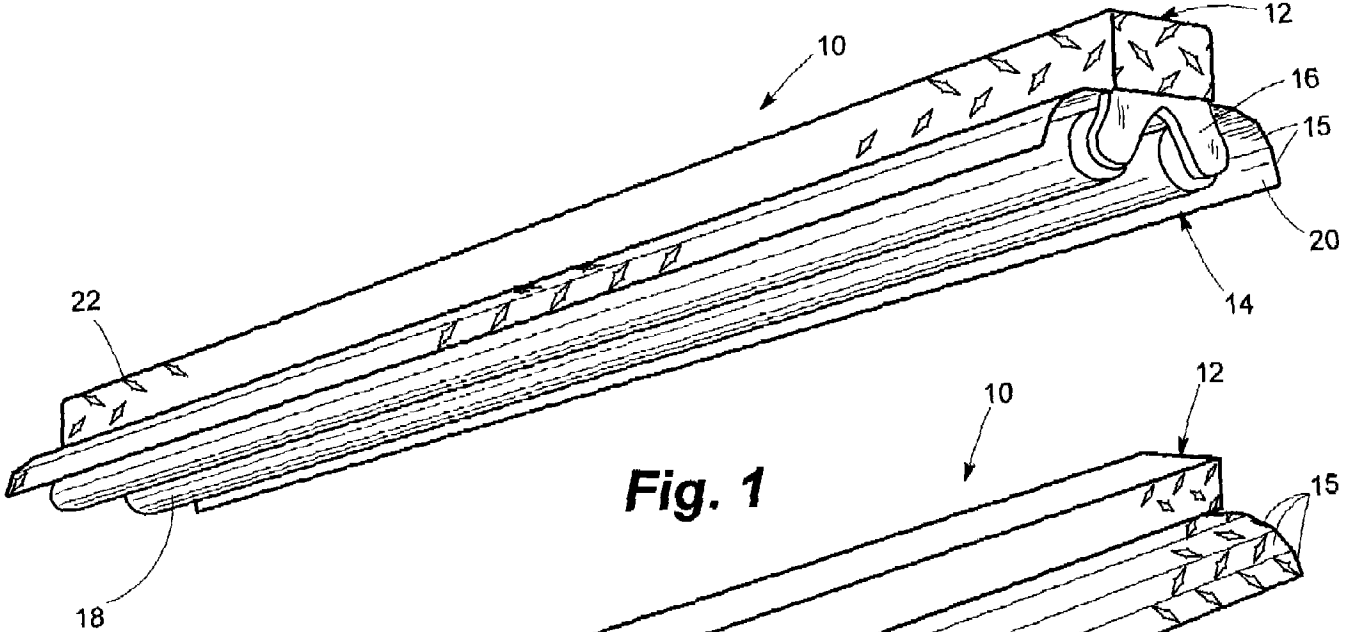
FIG. 1 a bottom perspective view of a first embodiment of a luminaire configured according to the invention.
Figure 2:
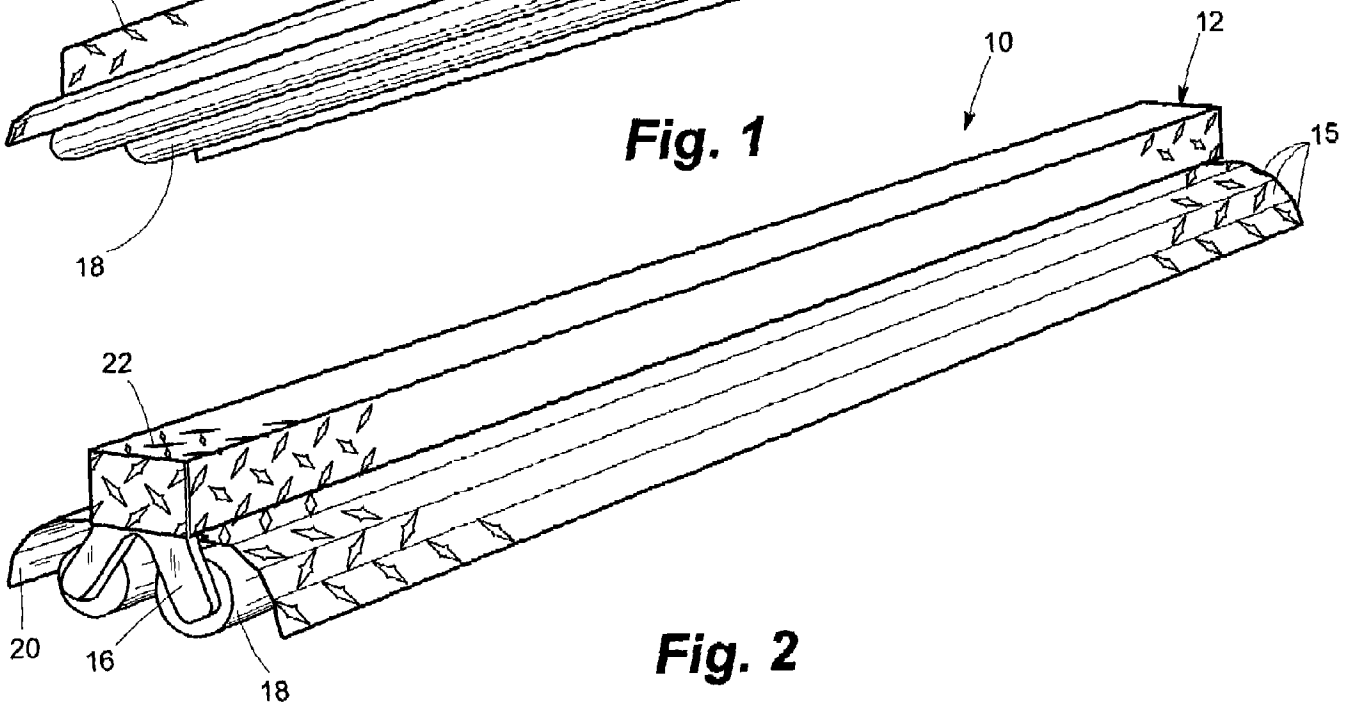
FIG. 2 is a top perspective view of the embodiment of invention shown in FIG. 1.
Figure 3:
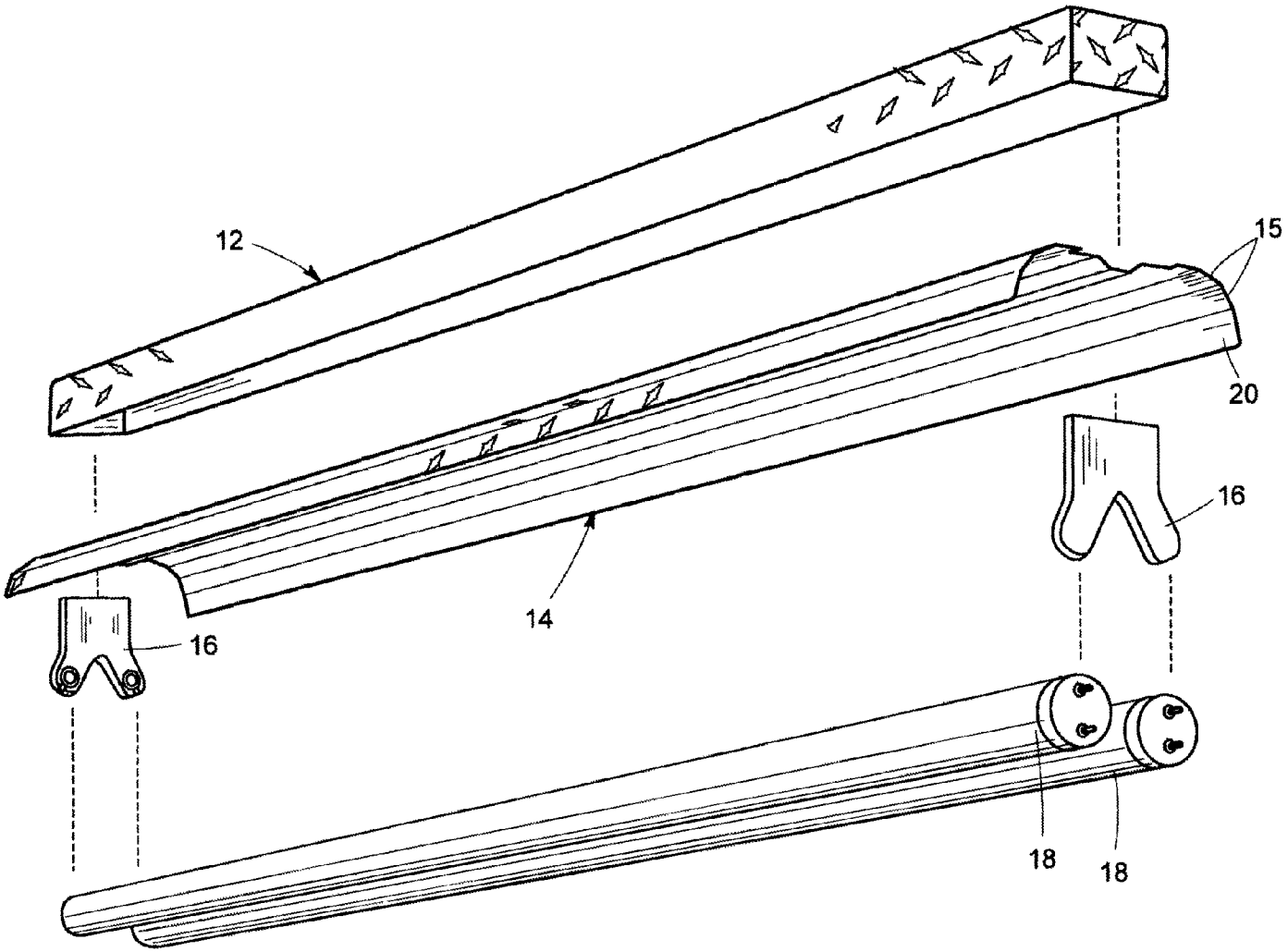
FIG. 3 is an exploded view of the luminaire of FIGS. 1 and 2 illustrating a separate channel member and reflector member as well as other components of the luminaire.

Referring now to the drawings and particularly to FIGS. 1 through 3, a luminaire 10 is seen to be configured for particular utility as a shoplight such as is usually suspended by wires or chains (not shown) from a ceiling of a work space or the like. Alternatively, the luminaire 10 could be surface-mounted to a ceiling or other surface of a work space. The luminaire 10 is formed to include a channel 12 having depending skirt reflectors 14 extending from either longitudinal edge of the channel 12. The skirt reflectors 14 are typically formed of an arcuate series of steps 15. Lamp holders 16 are typically mounted to either end of the channel 12 for mounting one or more lamps 18. It is to be understood the lamps 18 can be mounted by appropriate lamp holding structure other than is shown with power being supplied to the lamps through such lamp holding structure as is conventional in the art. In the embodiment of FIGS. 1 through 3, the channel 12 is separately formed from the reflectors 14, inner surfaces of the channel 12 reflecting some of the light generated by the lamps 18 although such surfaces are not relied upon for a major contribution to that light distributed from the luminaire 10. Light distributed from the luminaire 10 is primarily that light emanating directly from the lamp 10 and from the reflective surfaces 20 of the reflectors 14.

Figure 4A:
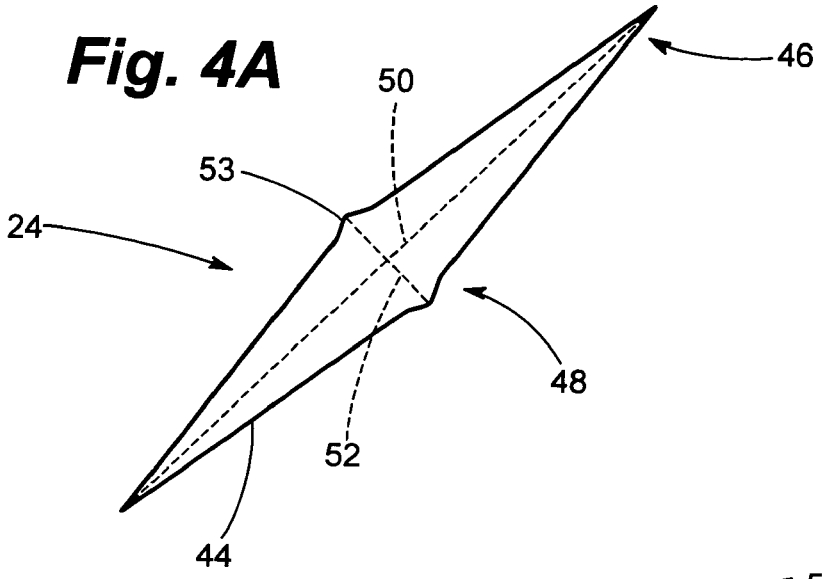
FIG. 4A is a detail of a single diamond element.
Figure 4B:
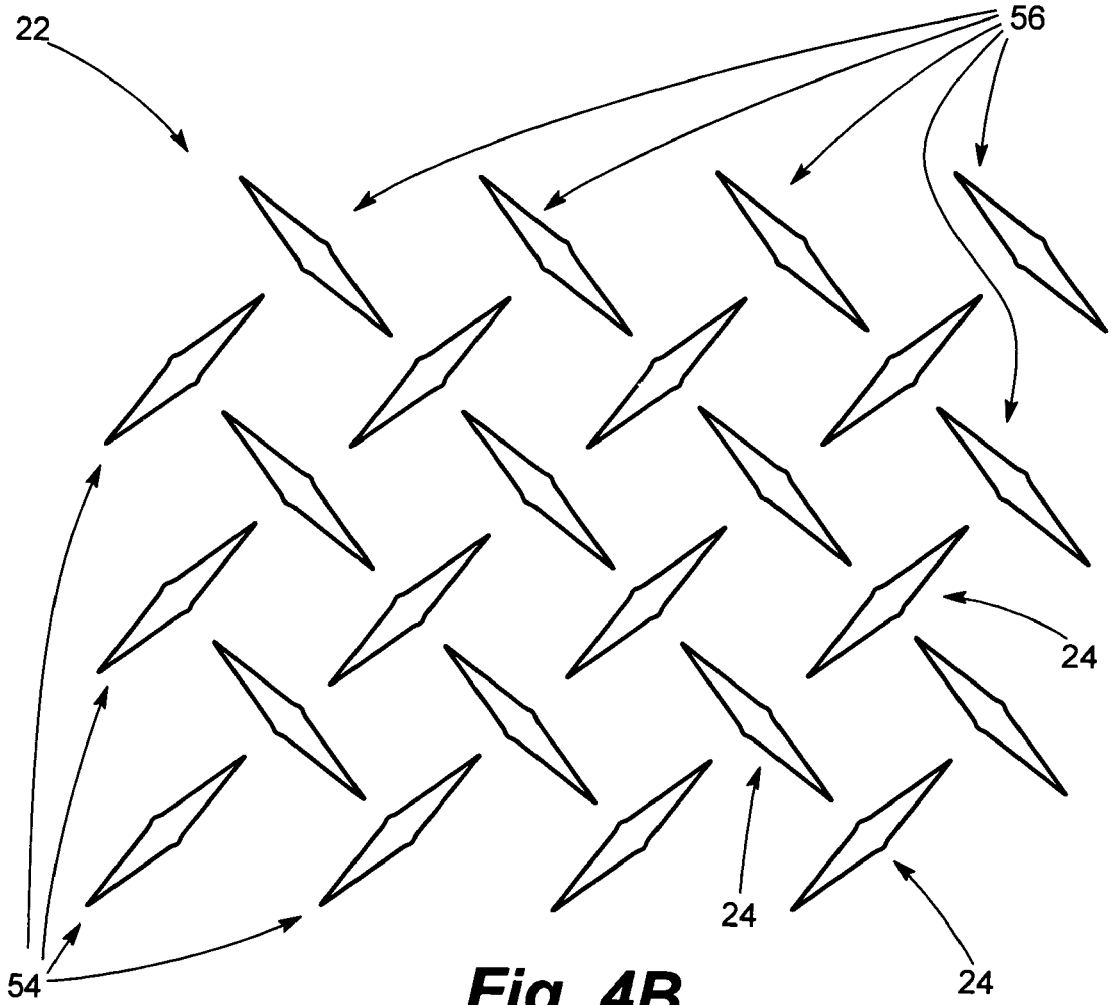
FIG. 4B is a detail view of a preferred diamond tread plate pattern usable according to the invention.

A pattern, such as that pattern seen in FIGS. 4A and 4B, inter alia is formed on outer surfaces of at least portions of the channel 12 and on upper surfaces of the reflectors 14 as is seen at 22. The pattern 22 is formed in a preferred embodiment of a multiplicity of diamond elements 24 that can be raised above the plane of ambient surfaces. It is to be understood that the material from which the housing 12 and the reflectors 14 are formed can be a material known as "diamond tread plate", a material typically formed of aluminum in a variety of thicknesses and used in the manufacture of non-slip tread plates, tool boxes and the like. It is also to be understood that the pattern 22 can be imparted to outer surfaces of the luminaire 10 such as is by embossment on surfaces of a given material used to form said luminaire 10 or can be applied to the luminaire 10 in any known manner such as by application of a sheet having the pattern 22 formed thereon. In other words, the pattern 22 need not be integrally formed in a material such as metal used for fabrication of either the housing 12 or the reflectors 14. Diamond tread plate material having a thickness of 0.036 inch is preferred.

As can be appreciated from a perusal of the luminaire 10 of FIGS. 1 through 3, the luminaire 10 so patterned is reminiscent of other articles associated with activities or persons, places or other things evocative of emotional responses on the part of a user of the luminaire 10. In particular, the pattern 22 has an association with automotive or similar activities usually involving pleasant or at least familiar aspects of the life of the user of the luminaire 10, such associations generally relating to particular work activities and/or leisure activities common to a particular segment of the population often subject to the pattern 22 from association with bed-mounted tool boxes carried by pick-up trucks or the like. The association with automotive activities extends to automobile racing or other pleasurable activities including, in particular, stock car racing such as is practiced both professionally and as a leisure activity.

The invention thus contemplates methodology for evoking a response on the part of a user of a luminaire such as the luminaire 10 by steps including the formation of a pattern such as the pattern 22 on surfaces of the luminaire 10. Visualization of the luminaire 10 so configured according to the invention causes the intended response on the part of a user of the luminaire to thereby cause feelings of well-being and/or enjoyment or the like, the user choosing to utilize a luminaire configured as is the luminaire 10 due to such favorable associations.

Referring to FIGS. 4A and 4B, the pattern 22 is seen in detail as being formed of a multiplicity of the diamond elements 24 arranged in a regular and repeating fashion in a preferred embodiment and such as is known as a diamond tread plate pattern. Each diamond element 24 is seen to have four sides 44 of substantially equal length, opposite included angles 46 being acute angles with opposite included angles 48 being obtuse angles. Each diamond element has a longitudinal axis 50 extending between apices of the acute angles 46 and constituting a length-wise dimension. A lateral axis 52 extends between apices of the obtuse angle 48 and constitutes a width-wise dimension. The axes 50 and 52 are perpendicular to each other. The longitudinal axis 50 in a preferred embodiment is at least twice the length of the lateral axis 52 and preferably three or more times said length, the resulting diamond element 24 having an elongated diamond shape. Each of the diamond elements 24 have a dimple 53 at the intersection of each pair of sides 44, it being understood that the intersections of the sides 44 medially of each of the diamond elements 24 can be otherwise configured such as straight-sided apices of the obtuse angles formed by the intersections of the sides 44. Rows 54 of certain of the diamond elements 24 have longitudinal axes aligned with adjacent apices of the elements being spaced apart approximately the same distance as a length of one of the longitudinal axes 50. Interposed between said rows 54 are rows 56 of aligned diamond elements 24 in an interdigitating relationship, lateral axes of the diamond elements 24 and of the rows 56 being perpendicular to longitudinal axes 50 of the diamond elements 24 in the rows 52, the diamond elements 24 in the rows 54 being spaced equidistantly from apices of the diamond elements 24 defined by the obtuse angles 48 in the rows 46, that is, located centrally therebetween. When placed on a luminaire such as the luminaire 10, the pattern 22 is preferably tilted at an angle of approximately 45° to edges of the channel 12 inter alia and the reflectors 14 inter alia as examples. The pattern 22 described relative to FIGS. 4A and 4B is a preferred pattern as being highly evocative of associations as referred to herein.

Figure 5A:
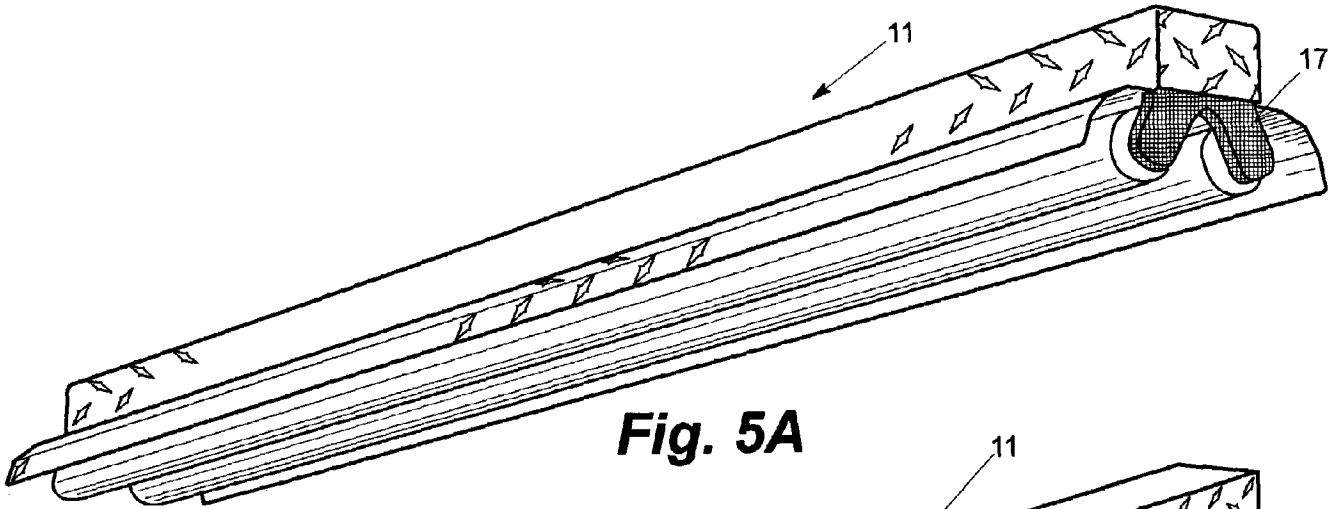
FIG. 5A is a bottom perspective view of a luminaire similar to the luminaire shown in FIG. 1 but with portions of lamp holders formed with a black coloration.
Figure 5B:
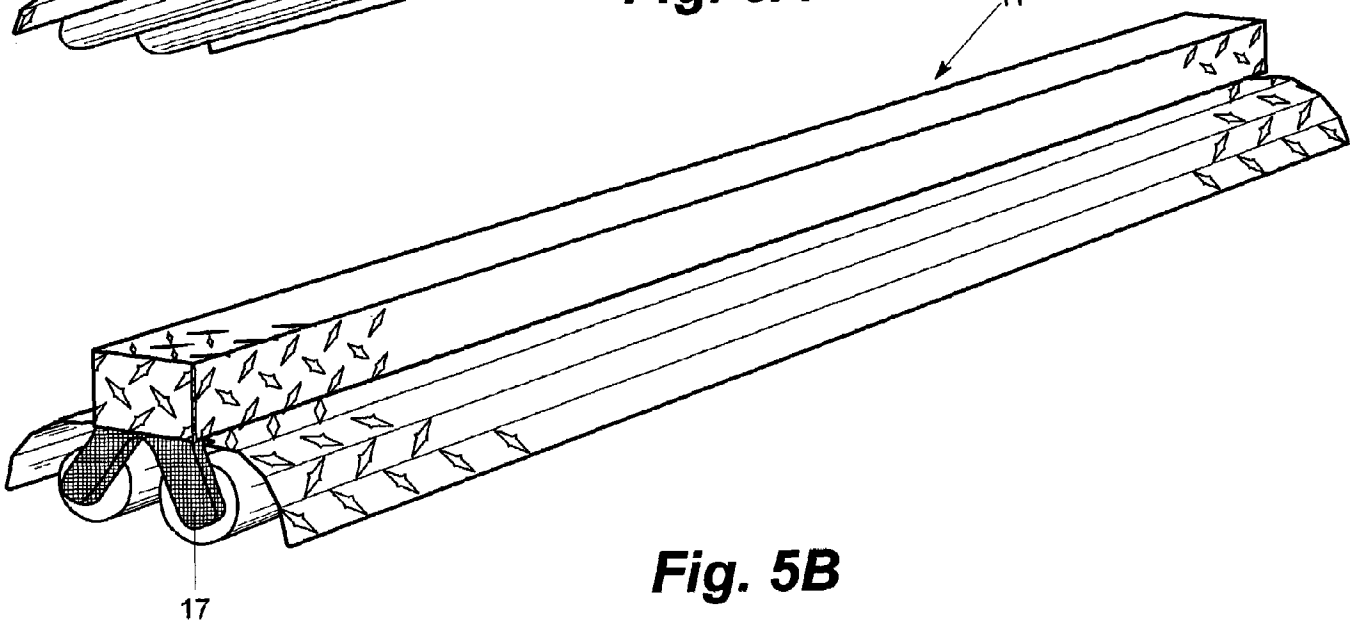
FIG. 5B is a top perspective view of the luminaire of FIG. 5A.

Referring now to FIGS. 5A and 5B, a luminaire 11 essentially identical to the luminaire 10 is seen to be formed with lamp holders 17 similar to the lamp holders 16 with the exception that the lamp holders 17 are colored, preferably a black color, to provide a further association with automotive activities.

Figure 6:
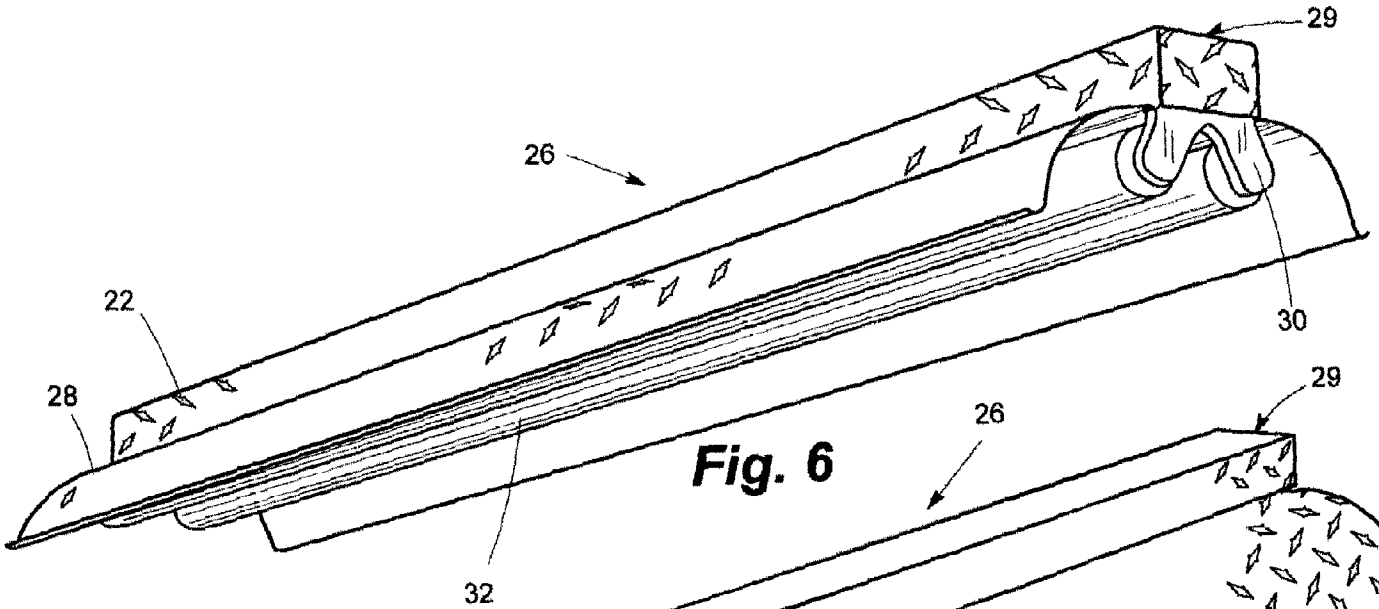
FIG. 6 is a bottom perspective view of a second embodiment of a luminaire configured according to the invention.
Figure 7:
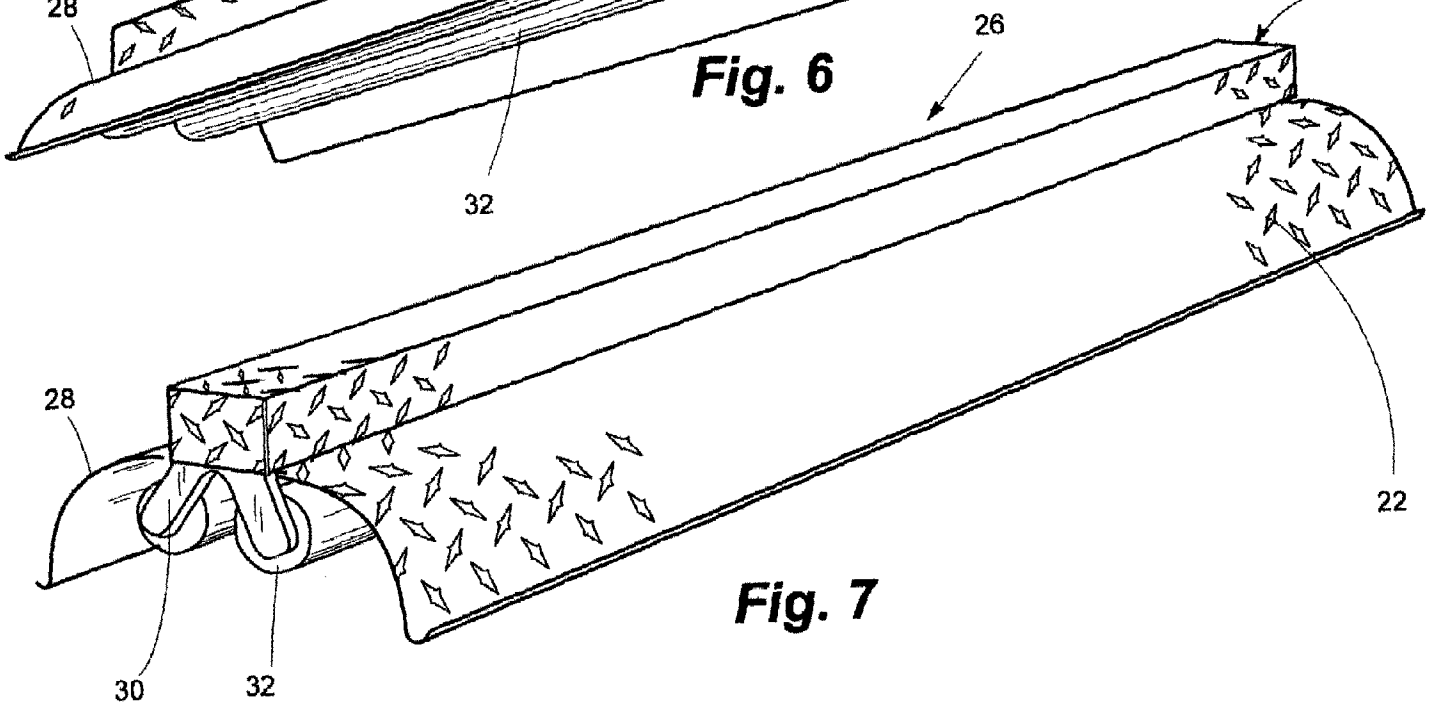
FIG. 7 is a top perspective view of the second embodiment of the invention.
Figure 8:
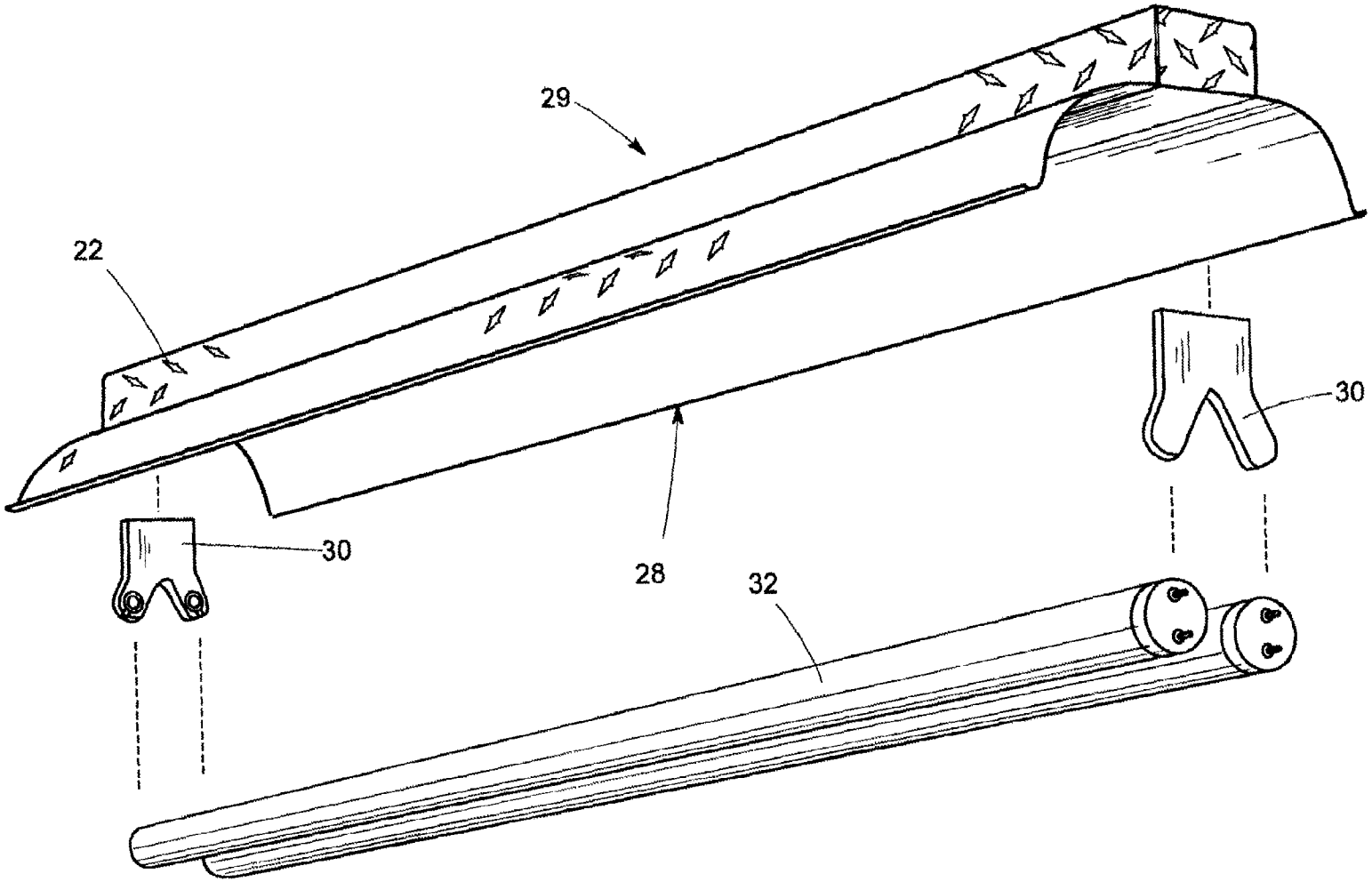
FIG. 8 is an exploded view of the luminaire of FIGS. 6 and 7 illustrating an integral channel and reflector as well as other elements forming the luminaire.

Referring now to FIGS. 6 through 8, a luminaire 26 is seen to be formed of a reflector 28 formed integrally with a channel portion 29, the reflector 28 being configured to function both as a housing or support as well as a primary reflective portion of the luminaire 26. Lamp holders 30 and lamps 32 mounted thereby are attached to the underside of the reflector 28, at least portions of outer surfaces of the reflector 28 having the pattern 22 of FIGS. 4A and 4B disposed thereon. Configuration and use of the luminaire 26 can be accomplished in ways similar to that described herein relative to the luminaire 10 inter alia.

Figure 9:
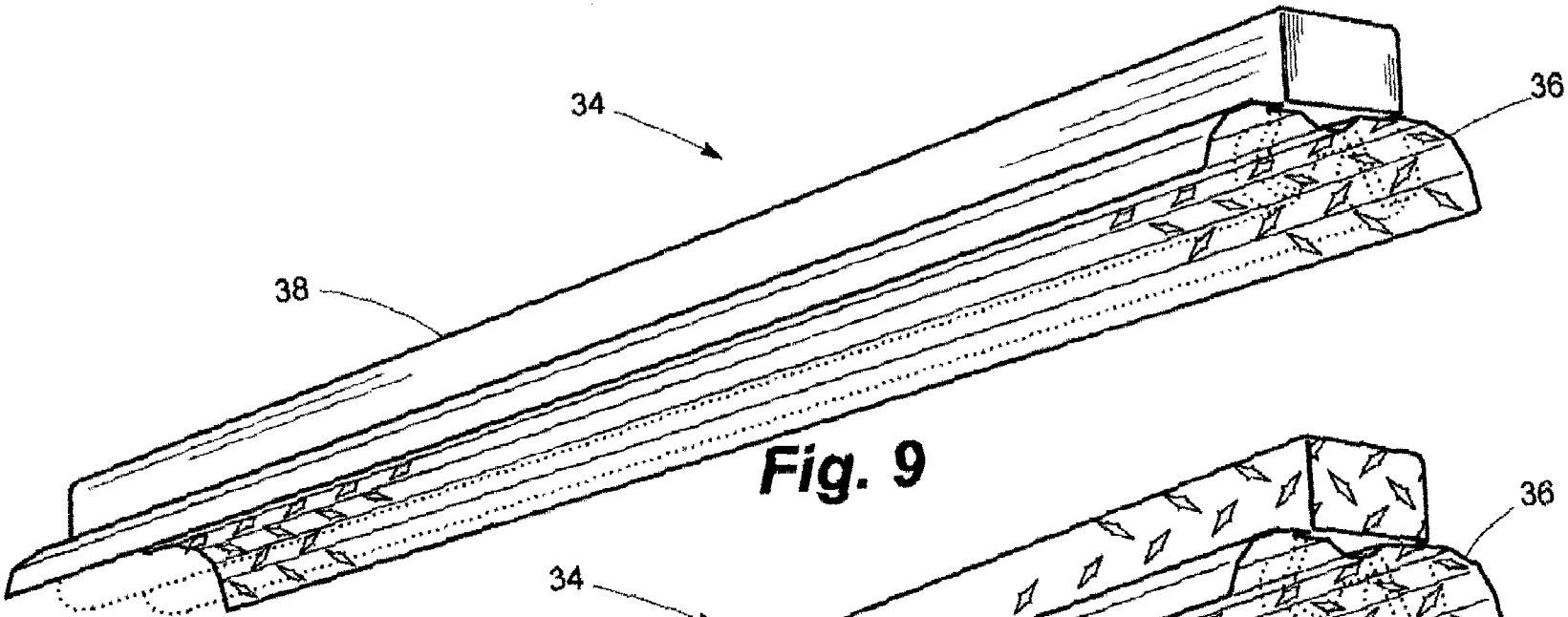
FIG. 9 is a bottom perspective view of another embodiment of a luminaire configured according to the invention and having a diamond tread plate pattern only on underside surfaces of a reflector portion thereof.
Figure 10:
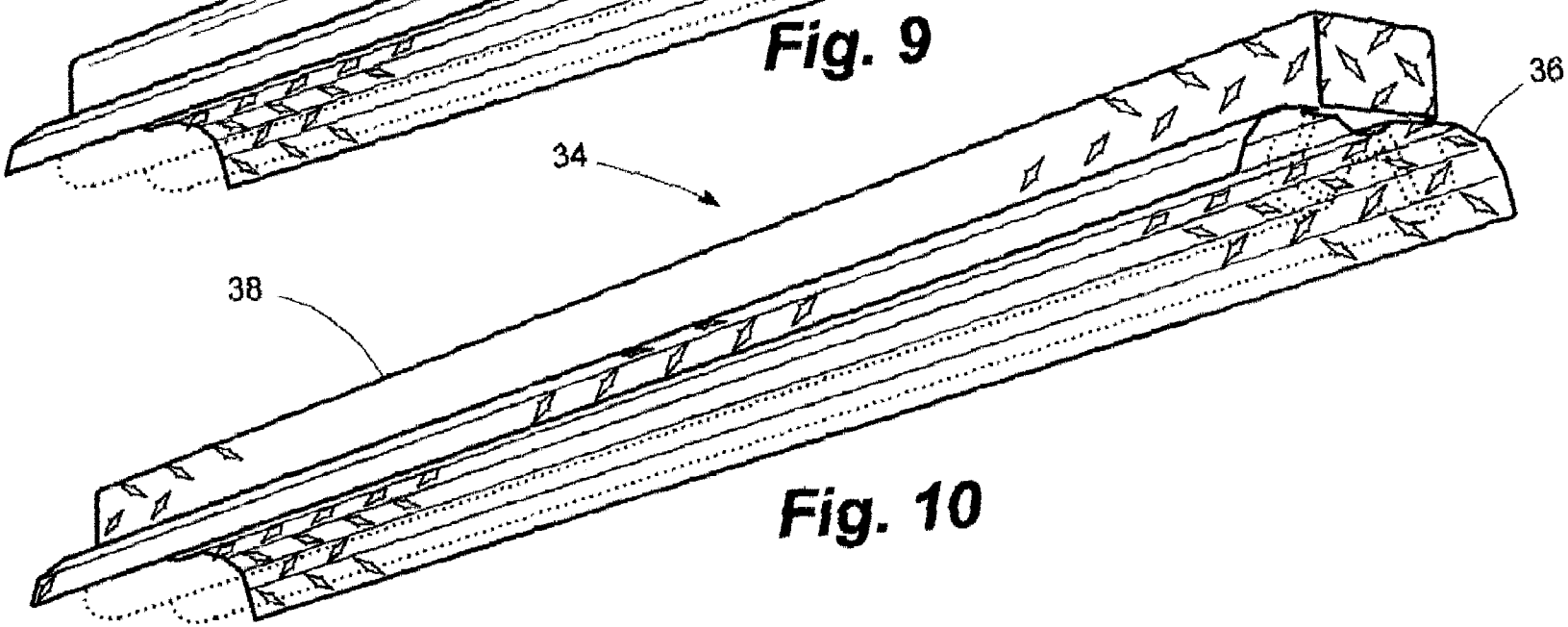
FIG. 10 is a bottom perspective view of a further embodiment of a luminaire configured according to the invention and illustrating a diamond tread plate pattern on both upper and lower surfaces thereof.
Figure 11A:
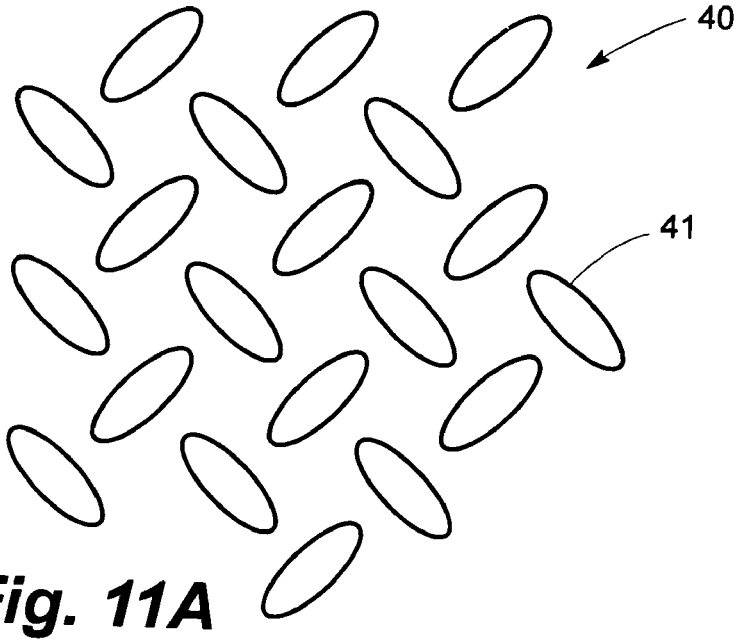
FIG. 11A is a detail view of another pattern as can be used according to the teachings of the invention.
Figure 11B:
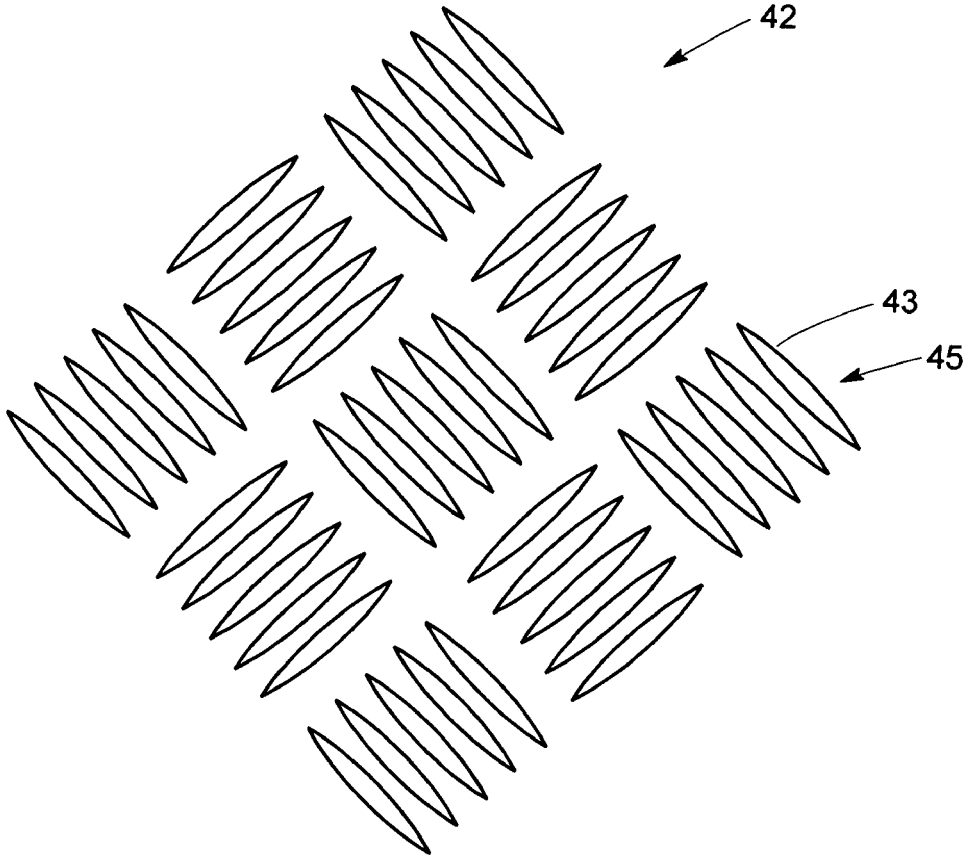
FIG. 11B is a detail view of a further pattern usable according to the invention.

Referring now to FIG. 9, a luminaire 34 is seen to be formed of a reflector 36 and a channel 38, only the underside of the reflector 36 having a pattern provided thereon. In FIG. 10, a luminaire 38 has a pattern formed on top and bottom surfaces thereof. The patterns formed on the luminaires 34 and 38 can be identical to the pattern 22 of FIGS. 4A and 4B or can take the appearance of patterns 40 and 42 of FIGS. 11A and 11B respectively or any pattern evocative of emotional responses as disclosed herein. The pattern 40 is seen to be formed of oval elements 41 similarly related to each other as are the diamond elements 24 of FIGS. 4A and 4B. In FIG. 111B diamond elements 43 are configured into a "herring bone" pattern with groups 45 of the diamond elements 43 having longitudinal axes thereof disposed perpendicularly to each other.

Figure 12:
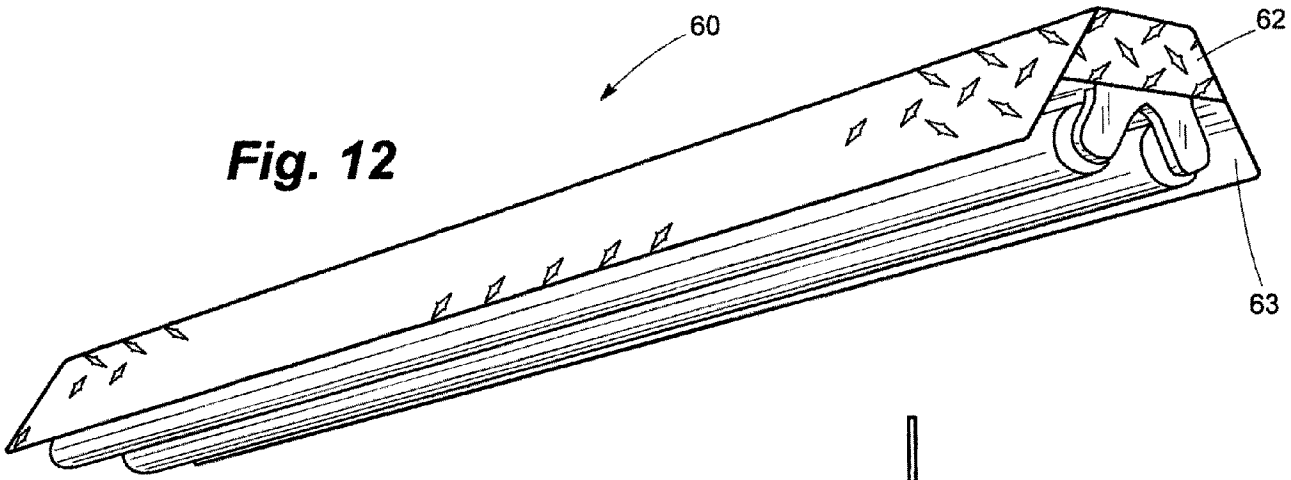
FIG. 12 is a bottom perspective view of yet another embodiment of a luminaire configured according to the invention; and, FIG. 13 is a bottom perspective view of a suspended luminaire configured according to the invention and having a frusto-conical reflector member formed with a pattern thereon according to the teachings of the invention.

Referring now to FIG. 12, a luminaire 60 is seen to essentially take an alternative form of a shoplight, a channel 62 also serving as supporting structure for reflective surfaces 63 formed on edge-wise portions thereof.

Figure 13:
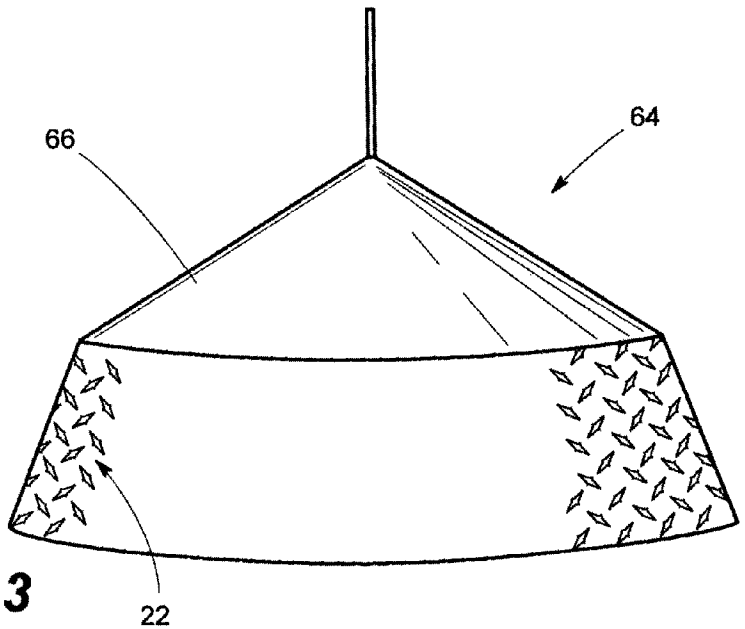

Referring now to FIG. 13, a luminaire 64 having a shaped reflector 66 of a substantially frusto-conical conformation such as is commonly employed in a suspended luminaire is seen, the luminaire 64 having a pattern such as the pattern 22 described herein formed thereon. The luminaire 64 is representative of a variety of luminaire types that can be configured according to the invention to provide the particular luminaire structures described herein for practice of the methodology disclosed herein. The invention contemplates configuration of a variety of luminaires as described herein without limitation as to luminaire type even though shoplights are particularly disclosed herein for practice of the methods of the invention. The patterns usable according to the invention can employ geometrical elements other than the diamond elements 24 or similarly dimensioned diamond elements and can be formed into useful patterns and angled relative to each other in a desired orientation. In all such patterns, the geometrical elements can be planar and coplanar with surfaces of the luminaires on which the patterns are disposed as desired. Alternatively, the geometrical elements can be raised or formed as depressions as desired. Further, the geometrical elements can be formed in or on the material from which the luminaires are fabricated integrally with such material or disposed otherwise thereon such as by being printed thereon or formed onto a layer of material which is then adhered to surfaces of the material from which the luminaires are fabricated.

Accordingly, it is to be understood that the invention can be practiced other than as is explicitly disclosed herein without departing from the intended scope of the invention as defined by the recitations of the appended claims.

What is claimed is:

1. A method for fabrication of a luminaire, comprising the steps of:

for a diamond tread plate pattern on at least certain surfaces of the luminaire, said pattern being impervious to light and visible to the user on use of the luminaire in a normally intended manner, the pattern being evocative of an association on the part of an intended user of the luminaire with a motor sport activity.

2. The method of claim 1 wherein the luminaire is a shoplight.

3. The method of claim 2 wherein the shoplight comprises a housing portion and at least one reflector portion.

4. The method of claim 3 wherein the housing portion and the reflector portion are integrally formed.

5. The method of claim 4 wherein the material comprising the housing portion also comprises the reflector portion.

6. A luminaire comprising:

surfaces visible to a user on ordinary operation of the luminaire; and, a diamond tread plate pattern formed on at least portions of the surfaces of the luminaire, the surfaces having the pattern formed thereon being impervious to light, the pattern being evocative of an association on the part of a user with a motor sport activity.

7. The luminaire of claim 6 wherein the luminaire is a shoplight.

8. The luminaire of claim 6 wherein the luminaire comprises a housing portion and at least one reflector portion.

9. The luminaire of claim 8 wherein material comprises the housing portion also comprises the reflector portion.

10. The luminaire of claim 9 wherein the housing portion and the reflector portion are integrally formed.

11. The luminaire of claim 6 wherein the luminaire has at least one lamp and lamp holders mounting the lamp, the lamp holders being colored a color reminiscent of the motor sport activity association with the pattern.

12. The luminaire of claim 11 wherein the color is black.

13. A luminaire comprising:

surfaces visible to a user on ordinary operation of the luminaire; and, a diamond tread pate pattern formed on at least portions of the surfaces of the luminaire, the surfaces having the pattern formed thereon being substantially opaque, the pattern being evocative of an association on the part of a user with a motor sport activity.

14. The luminaire of claim 13 wherein the luminaire is a shoplight.

* * * * *

UNITED STATES PATENT AND TRADEMARK OFFICE

CERTIFICATE OF CORRECTION

PATENT NO. : 7,011,428 B1
APPLICATION NO. : 10/625297
DATED : March 14, 2006
INVENTOR(S) : Mitchell Cecil Hand It is certified that error appears in the above-identified patent and that said Letters Patent is hereby corrected as shown below:

Column 6, line 64, delete “for” and insert -- forming --.

Signed and Sealed this

Eleventh Day of July, 2006

JON W. DUDAS
*Director of the United States Patent and Trademark Office*